US011812917B2

(12) United States Patent
Liang et al.

(10) Patent No.: US 11,812,917 B2
(45) Date of Patent: Nov. 14, 2023

(54) CLEANING SYSTEM

(71) Applicant: SHENZHEN SILVER STAR INTELLIGENT GROUP CO., LTD., Shenzhen (CN)

(72) Inventors: Zhijian Liang, Shenzhen (CN); Quanlong Lu, Shenzhen (CN)

(73) Assignee: SHENZHEN SILVER STAR INTELLIGENT GROUP CO., LTD., Shenzhen (CN)

( * ) Notice: Subject to any disclaimer, the term of this patent is extended or adjusted under 35 U.S.C. 154(b) by 552 days.

(21) Appl. No.: 17/002,132

(22) Filed: Aug. 25, 2020

(65) Prior Publication Data

US 2021/0127923 A1 May 6, 2021

(30) Foreign Application Priority Data

Nov. 5, 2019 (CN) ..... 201911068243.8

(51) Int. Cl.
*A47L 9/10* (2006.01)
*A47L 9/28* (2006.01)
*A47L 9/16* (2006.01)

(52) U.S. Cl.
CPC ..... *A47L 9/106* (2013.01); *A47L 9/1658* (2013.01); *A47L 9/2805* (2013.01); *A47L 9/2873* (2013.01); *A47L 2201/024* (2013.01); *A47L 2201/04* (2013.01)

(58) Field of Classification Search
CPC ..... A47L 9/2873; A47L 9/106; A47L 9/1658; A47L 9/2805; A47L 2201/024; A47L 2201/04
See application file for complete search history.

(56) References Cited

U.S. PATENT DOCUMENTS 8,749,196 B2 * 6/2014 Cohen ..... H02J 7/00309 320/109
10,952,578 B2 * 3/2021 Gill ..... A47L 9/2805
2011/0236026 A1 * 9/2011 Yoo ..... G05D 1/0234 375/259
2017/0196430 A1 * 7/2017 Machida ..... A47L 9/1683
2018/0199776 A1 * 7/2018 Sato ..... A47L 7/0047
(Continued)

FOREIGN PATENT DOCUMENTS

WO WO-2018235932 A1 * 12/2018 ..... A47L 9/102
WO WO-2020262863 A1 * 12/2020 ..... A47L 5/22
WO WO-2021064667 A1 * 4/2021 ..... A47L 5/38

*Primary Examiner* — Marc Carlson
(74) *Attorney, Agent, or Firm* — Gang Yu

(57) ABSTRACT

The present disclosure provides a cleaning system, comprising a cleaning robot and a processing station. The cleaning robot comprises a machine body, a trash discharging port and a sealing mechanism provided at the bottom of the machine body, and the sealing mechanism is configured to seal the trash discharging port. The processing station comprises a controller, an electromagnet, and a signal guiding component. The signal guiding component is configured to guide the cleaning robot to dock with the processing station, and the controller is configured to detect induction information on the processing station and control the electromagnet according to the induction information to generate a magnetic force to attract the sealing mechanism to open the trash discharging port.

19 Claims, 9 Drawing Sheets

(56) References Cited

U.S. PATENT DOCUMENTS

| | | | | |
|---|---|---|---|---|
| 2019/0146517 | A1* | 5/2019 | Ryu | G06T 7/74 701/28 |
| 2019/0202064 | A1* | 7/2019 | Wolff | B25J 11/0085 |
| 2020/0022553 | A1* | 1/2020 | Gill | A47L 9/1436 |
| 2020/0107685 | A1* | 4/2020 | Tanaka | A47L 9/122 |
| 2020/0170468 | A1* | 6/2020 | Nakayama | G01N 1/02 |
| 2020/0249688 | A1* | 8/2020 | Caussy | H02J 7/00034 |
| 2020/0353626 | A1* | 11/2020 | Wolff | A47L 9/2826 |
| 2020/0405107 | A1* | 12/2020 | Na | A47L 9/2815 |

* cited by examiner

CLEANING SYSTEM

CROSS-REFERENCE TO RELATED APPLICATIONS

This application is based upon and claims priority to Chinese Patent Application No. CN201911068243.8 filed on Nov. 5, 2019, the entire contents of which are incorporated herein by reference.

TECHNICAL FIELD

The present disclosure relates to the field of cleaning robots, and particularly to a cleaning system.

BACKGROUND

With the advancement of science and technology, people's lives have been gradually affected. In recent decades, robots have attracted much attention. Cleaning robots have been widely used in industrial production, life services, environmental detection, and other fields. An existing cleaning robot is usually provided with a dust box. When the dust box is full of trash, the user needs to remove the dust box from the cleaning robot himself and dump the trash. This method is more common, but increases the user's labor burden and is not conducive to the user's life experience. The trash discharge method of the latest cleaning robot of the U.S. Irobot is: designing a trash emptying station that cooperates with the cleaning robot. The emptying station is provided with a fan device that can suck trash. In this way, the user is prevented from manually removing the dust box to dump the trash. In addition, the sweeper of the U.S. Irobot is provided with plastic parts at the bottom to seal the trash port. The opening of the trash port requires the strong suction of the emptying station to suck the plastic parts away, which has high requirements on the suction of the fan. It will undoubtedly increase the manufacturing cost of the fan of the emptying station, and therefore the existing cleaning robot needs to be improved.

SUMMARY

There is provided a cleaning system according to embodiments of the present disclosure.

According to an aspect of embodiments of the present disclosure, there is provided a cleaning system, including a cleaning robot and a processing station. The cleaning robot includes a machine body, a trash discharging port and a sealing mechanism provided at the bottom of the machine body, and the sealing mechanism is configured to close the trash discharging port. The processing station includes a controller, an electromagnet, and a signal guiding component. The signal guiding component is configured to guide the cleaning robot to dock with the processing station, and the controller is configured to detect induction information on the processing station and control the electromagnet to generate a magnetic force to attract the sealing mechanism to open the trash discharging port according to the induction information.

DESCRIPTION OF REFERENCE NUMERALS

Figure 1:
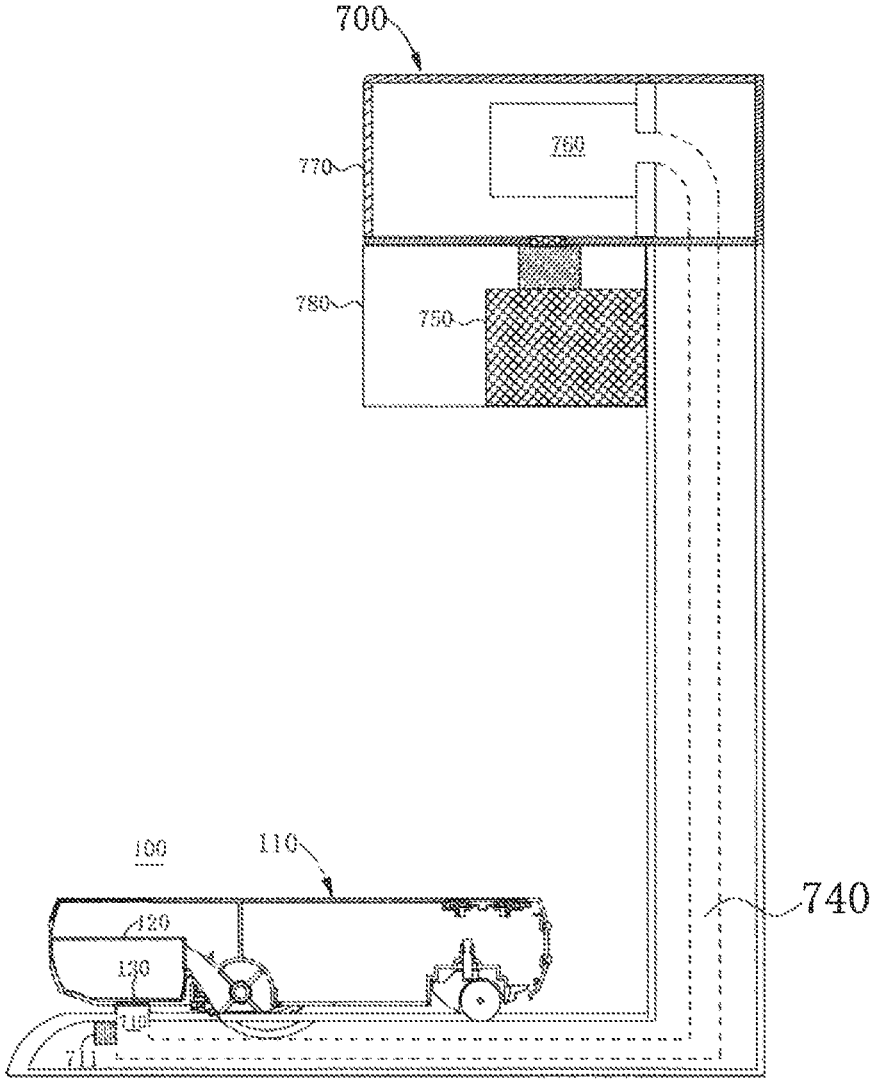
FIG. 1 is a schematic diagram of a cleaning system in a first embodiment according to the embodiments of the present disclosure.

Cleaning robot 100; machine body 110; dust box 120; sealing mechanism 130; trash discharging port 140; connecting tube 141; gear 150; conveyor belt 151; driving mechanism 160; resilient return mechanism 170; processing station 700; trash receiving port 710; electromagnet 711; groove 720; identification code 730; suction tube 740; suction device 750; trash collecting device 760; first storage portion 770; second storage portion 780.

DETAILED DESCRIPTION

In order to make the technical problems, technical solutions and beneficial effects solved by the present disclosure clearer, the following further describes the present disclosure in detail with reference to the accompanying drawings and embodiments. It can be understood that the specific embodiments described here are only used to explain the present disclosure, but not to limit the present disclosure.

The embodiments of the present disclosure are described in detail below. Examples of the embodiments are shown in the accompanying drawings, wherein the same or similar reference numerals indicate the same or similar elements or elements with the same or similar functions. The embodiments described below with reference to the accompanying drawings are exemplary, and are intended to explain the present disclosure, but should not be understood as limiting the present disclosure.

In the description of the present disclosure, it should be understood that the orientation or positional relationship indicated by the terms "lateral", "length", "width", "up", "down", "front", "back", "left", "right", "vertical", "horizontal", "top", "bottom", "clockwise", and "counterclockwise", etc. are based on the orientation or positional relationship shown in the drawings, and are only for ease of the describing the disclosure and simplifying the description rather than indicating or implying that the device or element referred to must have a specific orientation, be constructed and operated in a specific orientation, and therefore cannot be understood as a limitation to the present disclosure.

In addition, the terms "first" and "second" are only used for the descriptive purpose, and cannot be understood as indicating or implying relative importance or implicitly indicating the number of indicated technical features. Therefore, the features defined with "first" and "second" may explicitly or implicitly include at least one of the features. In the description of the present disclosure, "a plurality of" means at least two, such as two, three, etc., unless otherwise specified.

In the present disclosure, unless otherwise clearly defined and limited, the terms "mounted", "connected with", "connected to", "fixed" and other terms should be understood in a broad sense, for example, it may be a fixed connection or a detachable connection, or into a whole; it can be mechanically connected or electrically connected; it can be directly connected or indirectly connected through an intermediary, it can be the internal communication of two elements or the interaction relationship between two elements, unless otherwise specified. For those of ordinary skill in the art, the specific meanings of the above terms in the present disclosure can be understood according to specific circumstances.

In the present disclosure, unless otherwise clearly defined and defined, the first feature being "on" or "under" the second feature can be direct contact between the first feature and the second feature, or the first and second features may indirectly contact through an intermediary. Moreover, the first feature being "on", "above" and "overlying" the second feature may mean that the first feature is directly above or obliquely above the second feature, or it simply means that the level of the first feature is higher than the second feature. The first feature "under", "below" and "beneath" the second feature may mean that the first feature is directly below or obliquely below the second feature, or it simply means that the level of the first feature is smaller than the second feature.

The present disclosure will be further described below in conjunction with the drawings and embodiments.

Figure 3:
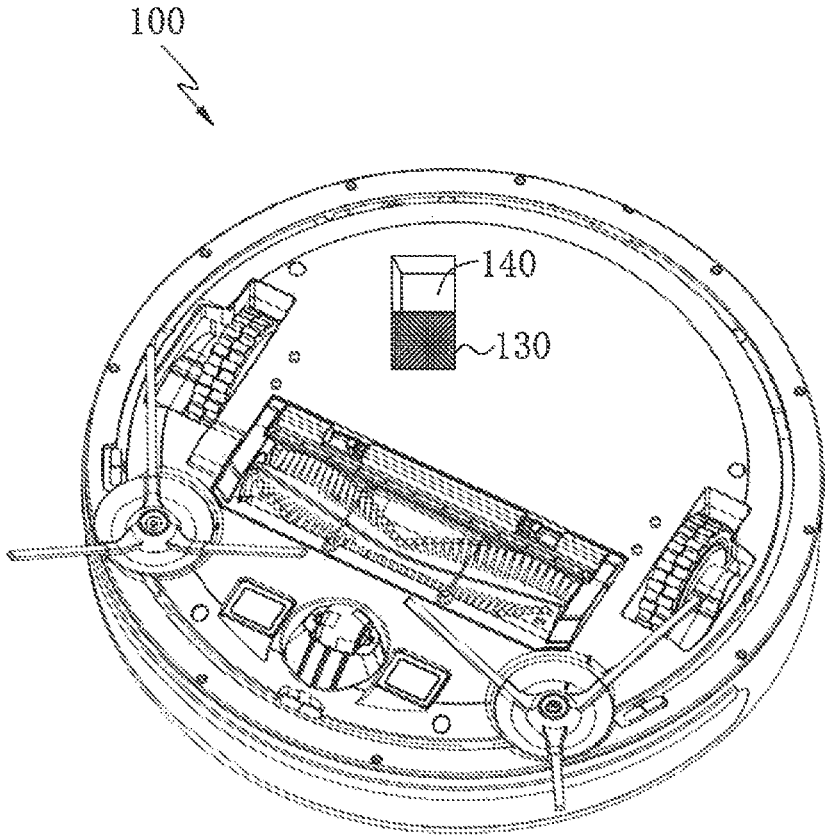
FIG. 3 is a schematic diagram of a cleaning robot according to the embodiments of the present disclosure.
Figure 11:
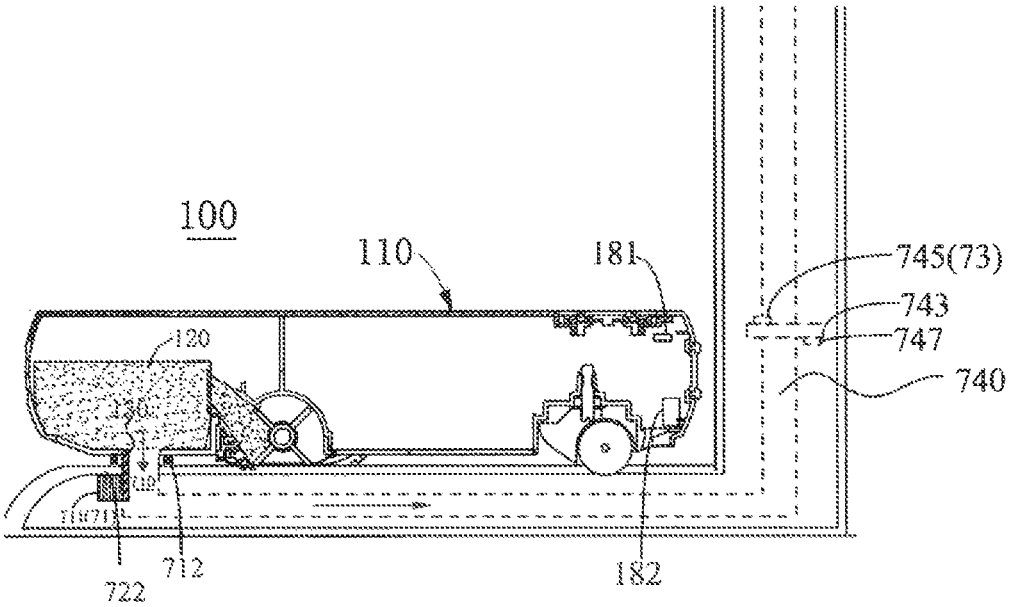
FIG. 11 is a partial view of the cleaning system.
Figure 12:
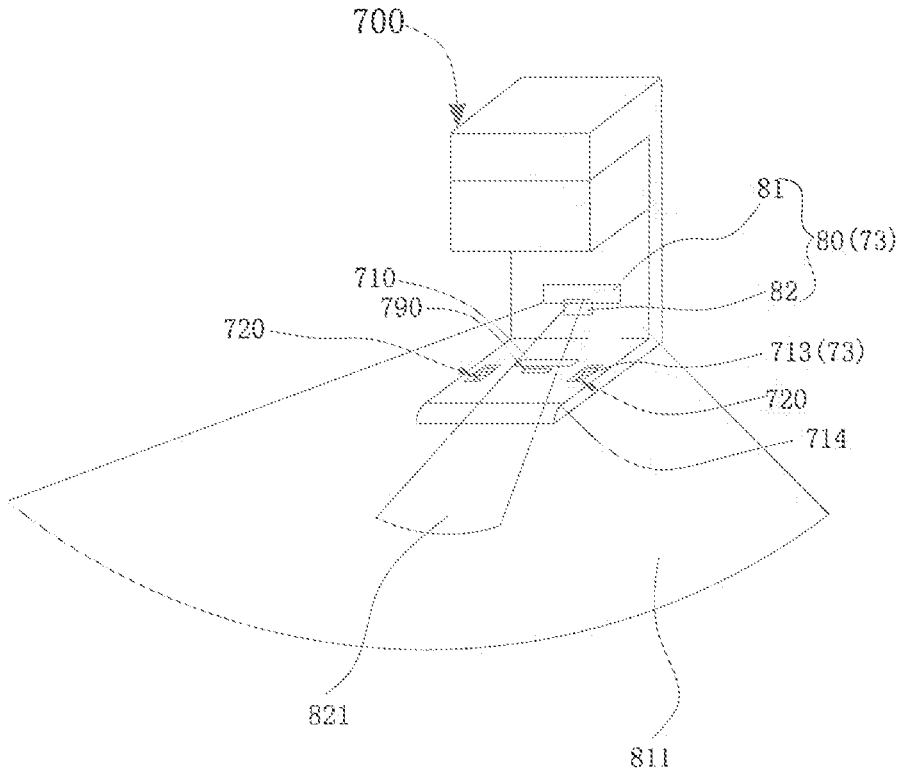
FIG. 12 is another schematic diagram of the cleaning system according to the embodiments of the present disclosure, for showing a signal guiding component.

Referring to FIG. 1, the present disclosure provides a cleaning system including a cleaning robot 100 and a processing station 700. Referring to FIG. 3, FIG. 3 is a schematic diagram of a cleaning robot 100 according to the embodiments of the present disclosure, the cleaning robot 100 includes a machine body 110, a trash discharging port 140 and a sealing mechanism 130 disposed at the bottom of the machine body 110. The sealing mechanism 130 is configured to close the trash discharging port 140. The sealing mechanism 130 is provided near the trash discharging port 140 and is movably connected to the bottom of the cleaning robot 100. As shown in FIG. 11 and FIG. 12, the processing station 700 includes a controller 747, a sealing mechanism actuating device 71 and a docking sensing assembly 73. The sealing mechanism actuating device 71 is configured to make the movement of the sealing mechanism 130 to open or close the trash discharging port 140. The sealing mechanism actuating device 71 may be an electromagnet 711, an auxiliary mechanism 790, or other actuating devices that is able to push the sealing mechanism 130 to move to open the trash discharging port 140. The auxiliary mechanism may be a mechanical structure, such as a protrusion, hook, etc, or a combination of mechanical structure and electromagnet that is able to push the sealing mechanism 130 to move to open the trash discharging port 140. The docking sensing assembly 73 is configured to sense whether the cleaning robot 100 have docked with the processing station 700. The docking sensing assembly 73 may be a pressure sensor 713 arranged on the base of the processing station 700, and the pressure sensor 713 generates pressure sensing information when sensing the pressure of the cleaning robot 100. In one embodiment, the docking sensing assembly 73 may include an identification code 730 arranged on the side wall of the processing station 700. Correspondingly, the cleaning robot 100 is provided with an alignment recognition device 182 that recognizes the identification code 730. In one embodiment, the docking sensing assembly 73 may include a light receiver 745 arranged in the processing station 700. Correspondingly, the cleaning robot 100 is provided with a light emitter 181 of the cleaning robot 100 emits light, and the light receiver 745 of the processing station 700 receives the light. The light is received and converted into sensing information. In an embodiment, the docking sensing assembly 73 may include a signal guiding component 80 for guiding the cleaning robot 100 to determine the position of the processing station 700 and to dock with the processing station 700, and outputting a sensing information when the cleaning robot 100 dock with the processing station 700. The controller 747 is configured to obtain sensing information from the docking sensing assembly 73, and control the sealing mechanism actuating device 71 to move the sealing mechanism 130 to open the trash discharging port 140, when the sensing information indicates that the cleaning robot 100 and the processing station 700 have been docked.

In this application, the controller 747 detects the information on the processing station 700 in real time, and opens the sealing mechanism 130 of the cleaning robot 100 in time by means of the suction force generated by an electromagnet 711 or by the means of the auxiliary mechanism 790, thereby opening the trash discharging port 140 to realize the intelligent discharge of trash, and not requiring the suction device 750 of the processing station 700 to provide a strong suction force, reducing the suction force requirement on the maintenance station, and thus reducing the manufacturing cost of the processing station 700, releasing the intelligent discharge of trash by the cleaning robot 100, and improving the user experience.

The processing station 700 includes a controller 747 and an electromagnet 711, and the controller is configured to detect the induction information on the processing station 700 and control the electromagnet 711 to generate a magnetic force to attract the sealing mechanism 130 according to the induction information. The trash discharging port 140 of the cleaning robot 100 may be attached or be engaged to the trash receiving port 710 of the processing station 700. The sealing mechanism 130 is made of iron, ferroalloy, or other metal. When the trash discharging port 140 and the trash receiving port 710 are close enough, the magnetic force generated by the electromagnet 711 makes the sealing mechanism 130 deflect downward, and the sealing mechanism 130 opens the trash discharging port 140. Further, referring to FIG. 2, the processing station 700 includes a base 714, a suction tube 740, and a trash collecting device 760. The base 714 is provided with a trash receiving port 710, and the suction tube 740 is communicated with the trash receiving port 710 and the trash collecting device 760. Referring to FIG. 11, an extension structure 712 extending toward the edge of the trash receiving port 710 is provided near the trash receiving port 710. When the trash receiving port 710 is docked with the trash discharging port 140 of the cleaning robot 100, the extension structure 712 and the sealing mechanism 130 seals the gap between the trash receiving port 710 and trash discharging port 140, so as to form a closed space. By improving the sealing between the trash receiving port 710 and the trash discharging port 140, it is convenient for the suction device 750 to better suck out dust particles and at the same time prevents dust particles from leaking from the trash discharging port 140.

The processing station 700 includes a first storage portion 770, a second storage portion 780, and a suction device 750. The trash collecting device 760 is arranged in the first storage portion 770, and the suction device 750 is mounted in the second storage portion 780, the first storage portion 770 and the second storage portion 780 are in pneumatic communication. Specifically, the trash collecting device 760 may be a gas-permeable trash collection bag or a gas-permeable trash collection box with a filter. The first storage portion 770 is arranged above the second storage portion 780. A vent is disposed at the junction of the first storage portion 770 and the second storage portion 780, through which the first storage portion 770 is communicated with the second storage portion 780. The second storage portion 780 is communicated with the outside. Refer again to FIG. 2, the air flow direction is indicated by the arrow in FIG. 2, and the flow direction of the dust particles inside the cleaning robot 100 is approximately the same as the air flow direction. The dust particles successively pass through trash receiving port 710 of the processing station 700 from the trash discharging port 140 and enter the suction tube 740 of the processing station 700, and then, under the power of the suction device 750, enter the trash collecting device 760 along the suction tube 740 to complete the collection of trash. The internal air passes through the trash collecting device 760, enters the suction device 750 in the second storage portion 780 along the junction of the first storage portion 770 and the second storage portion 780, and then flows out from the vent which connects the second storage portion 780 to the outside.

There are two specific ways to open the trash discharging port 140 of the present application. Two embodiments of the trash discharging port 140 are described below.

Figure 2:
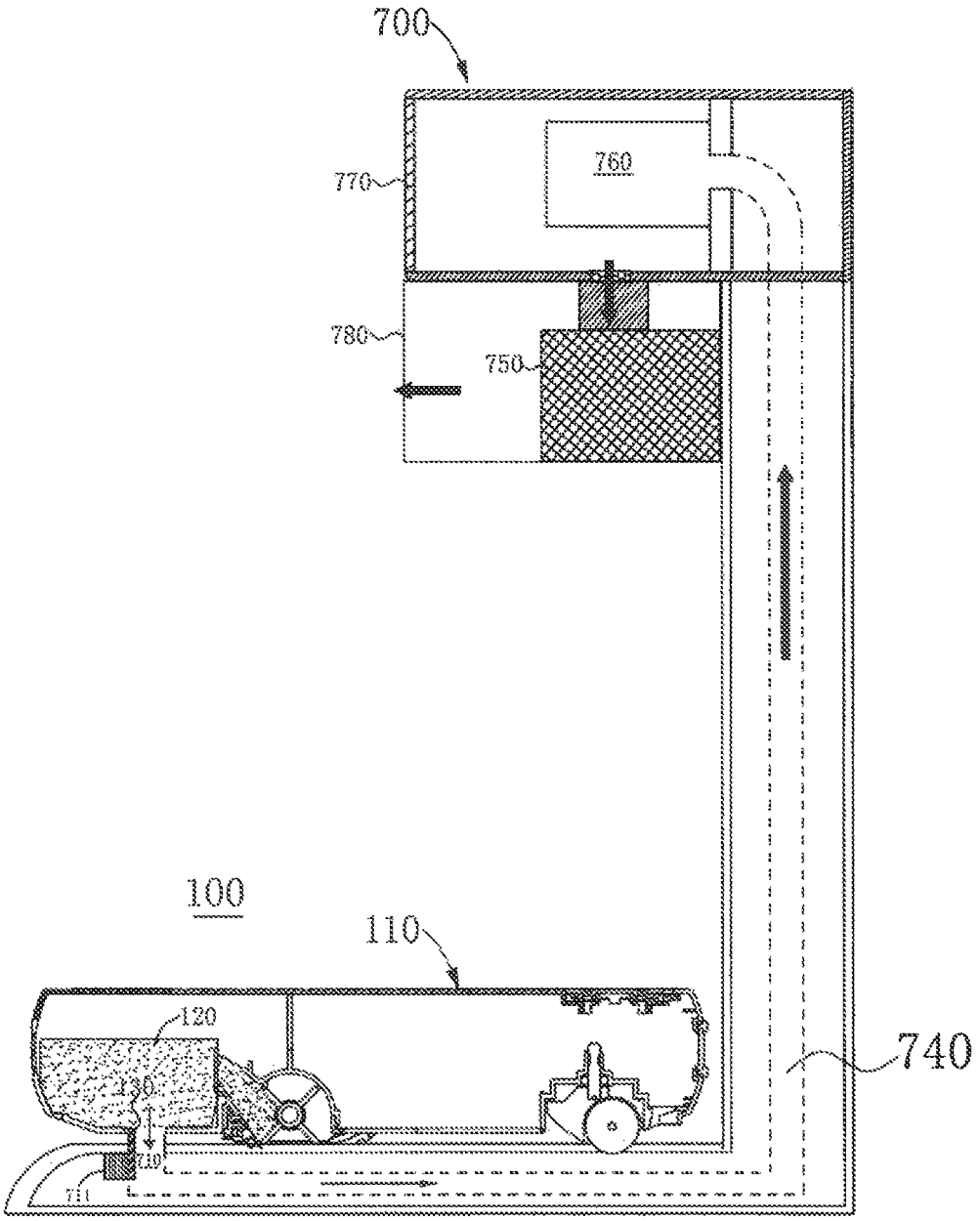
FIG. 2 is another schematic diagram of the cleaning system in the first embodiment according to the embodiments of the present disclosure.

For the first embodiment, as shown in FIG. 1, FIG. 1 is a schematic diagram of a cleaning system in a first embodiment according to the embodiments of the present disclosure. Particularly, as shown in FIG. 1, when in the initial state, the processing station 700 guides the cleaning robot 100 to move towards the processing station 700. Referring to FIG. 11, the processing station 700 includes a ramp 722. The processing station 700 includes a pressure sensor 713 disposed on the ramp 722. The pressure sensor 713 is configured to detect the pressure information on the processing station 700 and transmit the pressure information to the controller 747. At first, the trash discharging port 140 is closed by the sealing mechanism 130. When the controller 747 receives the pressure information, the controller 747 determines that the cleaning robot 100 has reached the designated position on the processing station 700, and the trash discharging port 140 of the cleaning robot 100 and the processing station 700 has been correctly docked. At this time, the controller 747 sends an instruction to instruct an circuit module 743 to supply power to the electromagnet 711, so that the electromagnet 711 generates magnetic force after being energized, and generates a suction force on the sealing mechanism 130, so that the sealing mechanism 130 is attracted to rotate downwards to open the trash discharging port 140. The sealing mechanism 130 is made of metal material. After the sealing mechanism 130 is sucked open, particularly as shown in FIG. 2, FIG. 2 is another schematic diagram of the cleaning system in the first embodiment according to the embodiments of the present disclosure, the trash discharging port 140 is open, the suction device 750 of the processing station 700 generates suction force to suck dust particles and other trash in the cleaning robot 100 along the direction indicated in the figure. Further, when the pressure information is within a preset range, the controller 747 controls the electromagnet 711 to generate a magnetic force to attract the sealing mechanism 130 to open the trash discharging port 140. The preset range is relevant to the weight of the cleaning robot The ramp 722 is provided with a groove 720, in which the pressure sensor 713 is mounted. In this application, the first predetermined value is set to avoid that when foreign matter falls on the groove 720 of the processing station 700, the controller 747 makes a misjudgment and allows the suction device 750 of the processing station 700 start to suck trash, which causes a waste of electric energy. The first predetermined value is set according to the weight of the cleaning robot 100. In this application, the controller 747 detects the pressure information on the processing station 700 in real time, and opens the sealing mechanism 130 of the cleaning robot 100 in time by means of the suction force generated by the electromagnet 711, thereby opening the trash discharging port 140 to realize the intelligent discharge of trash, and not requiring the suction device 750 of the processing station 700 to provide a strong suction force, reducing the suction force requirement on the maintenance station, thereby reducing the manufacturing cost of the processing station 700, releasing the intelligent discharge of trash by the cleaning robot 100, and improving the user experience.

Figure 4:
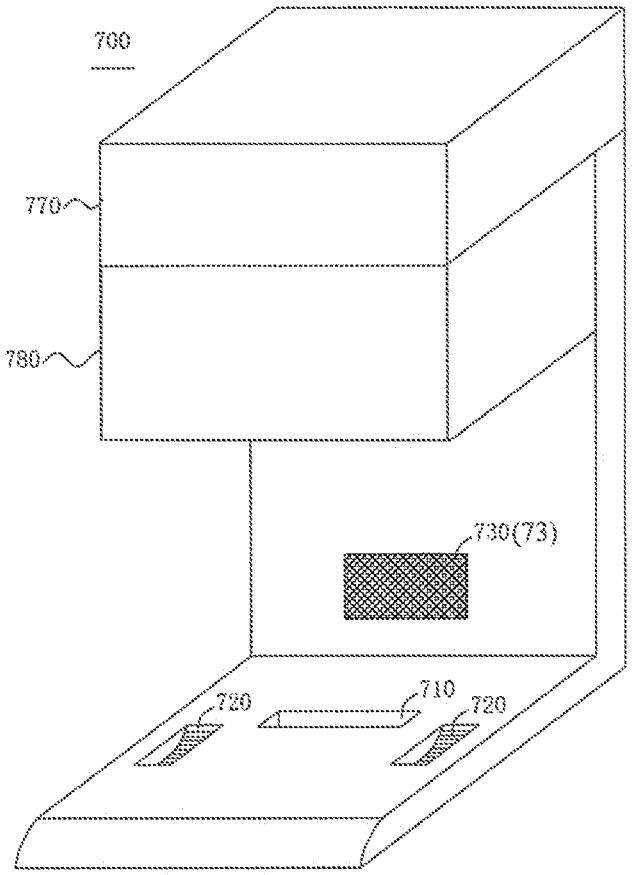
FIG. 4 is a schematic diagram of a processing station according to the embodiments of the present disclosure.

Alternatively, please referring to FIG. 4, FIG. 4 is a schematic diagram of a processing station 700 according to the embodiments of the present disclosure. The processing station 700 is provided with an identification code 730. Referring to FIG. 11, the cleaning robot 100 is provided with a light emitter 181, the ramp 722 of the processing station 700 is correspondingly provided with a light receiver (not shown). Alternatively, referring to FIG. 11, the light receiver (namely light receiver 745) may be arranged on a circuit module 743 which is arranged on the side wall of the processing station 700. The identification code 730 is disposed on the side wall of the processing station 700, the side wall is opposite to the cleaning robot 100, and the cleaning robot 100 is provided with an alignment recognition device 182 for recognizing the identification code 730 to generate induction information. The alignment recognition device 182 is arranged at the periphery of the cleaning robot 100, if and only when the cleaning robot 100 travels along the ramp 722 of the processing station 700, the alignment recognition device 182 is closed to the identification code 730 on the side wall of the processing station 700 and the alignment recognition device 182 detects the identification code 730, and then the light emitter of the cleaning robot 100 emits light, and the light receiver 745 on the processing station 700 receives the light. The light receiver 745 is arranged on a circuit which is provided with a photoelectric sensor. The photoelectric sensor generates a corresponding current signal on the circuit after sensing a light signal, and the controller 747 controls the loop where the electromagnet 711 is to generate a current according to the current signal, so that the electromagnet 711 generates the magnetic force to attract the sealing mechanism 130 away. The present solution accurately determines the position of the cleaning robot 100 on the processing station 700 by means of the alignment recognition device 182, so that when the cleaning robot 100 arrives the trash discharge position on the processing station 700, the processing station 700 timely senses and controls the electromagnet 711 to open the sealing mechanism 130. The cleaning robot 100 discharges trash, the suction device 750 of the processing station 700 provides power, and the trash collecting device 760 sucks in the trash, realizing the intelligent discharge of trash and improving the user experience.

Referring to FIG. 11, the processing station 700 includes a circuit module 743 which refers to the hardware structure and part of the circuit disposed on the internal circuit of the processing station 700. The circuit module 743 is electrically connected to the electromagnet 711. When detecting the induction information, the controller 747 controls the circuit module 743 to generate a current to cause the electromagnet 711 to generate a magnetic force to attract the sealing mechanism 130. The cleaning robot 100 discharges trash, the suction device 750 of the processing station 700 provides power, and the trash collecting device 760 sucks in the trash, which realizes the intelligent discharge of trash without requiring the user to personally handle the trash on the cleaning robot 100, which improves the user experience.

Figure 5:
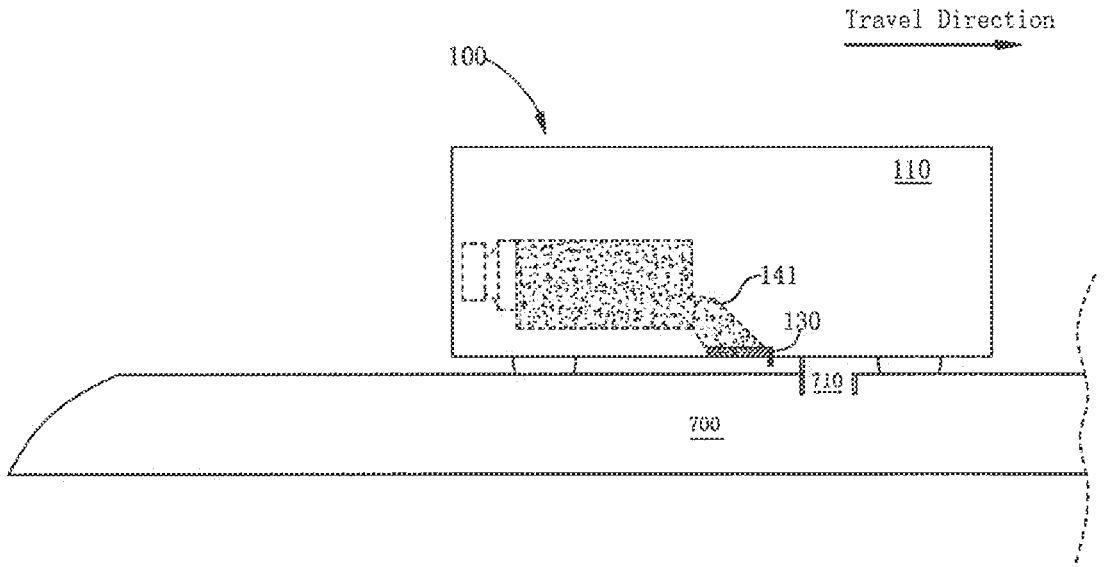
FIG. 5 is a schematic diagram of a cleaning system in a second embodiment according to the embodiments of the present disclosure.
Figure 6:
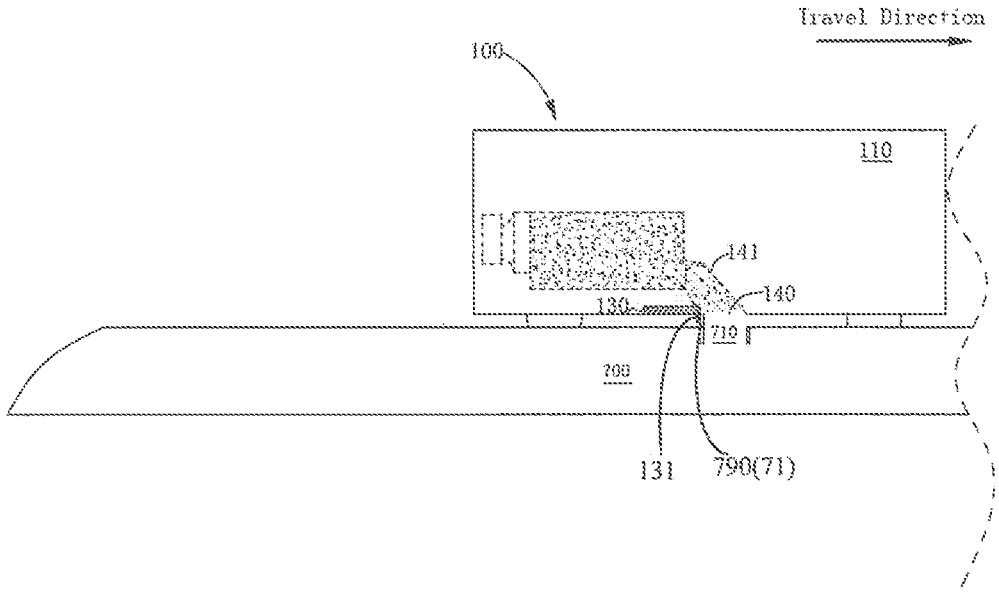
FIG. 6 is another schematic diagram of the cleaning system in the second embodiment according to the embodiments of the present disclosure.

For a second embodiment, please referring to FIG. 5 and FIG. 6, FIG. 5 is a schematic diagram of a cleaning system in the second embodiment according to the embodiments of the present disclosure, and FIG. 6 is another schematic diagram of the cleaning system in the second embodiment according to the embodiments of the present disclosure, that is, an auxiliary mechanism is introduced to open the sealing mechanism 130 on the basis of the electromagnet 711. Referring to FIG. 6 and FIG. 12, the processing station 700 includes a signal guiding component 80 and the auxiliary mechanism 790. The signal guiding component 80 is configured to guide the cleaning robot 100 to dock with the processing station 700. When the signal guiding component 80 guides the cleaning robot 100 to travel, the auxiliary mechanism 790 pushes away the sealing mechanism 130. The sealing mechanism 130 may be a sealing plate arranged at the bottom of the machine body 110 and located outside. Alternatively, the signal guiding component 80 includes a first signal guiding component 81 and a second signal guiding component 82. The first signal guiding component 81 can radiate signals to the surroundings so that the cleaning robot 100 can determine the position of the processing station 700 through the signal receiver. The radiation range of the first signal guiding component 81 is a first signal region 811. The first signal guiding component 81 is arranged on a part of processing station 700 above the base 714, the second signal guiding component 82 is configured to guide the cleaning robot 100 to accurately dock with the processing station 700. The radiation range of the second signal guiding component 81 is a second signal region 812. The second signal region 812 at least covers the trash receiving port 710 which is docked with the trash discharging port 140 of the cleaning robot 100. The second signal guiding component 82 is arranged on the second storage portion. The first signal guiding component 81 is configured to periodically emit light to the surroundings so that the cleaning robot 100 can find the processing station 700, that is, the cleaning robot 100 realizes the positioning of the processing station 700 through the first signal guiding component 81, and realizes the precise docking with the processing station 700 through the second signal guiding component 82. Alternatively, the auxiliary mechanism 790 is arranged near the trash receiving port 710, the signal guiding component 80 includes a plurality of signal transmitters mounted in the mounting box of the base, and the cleaning robot 100 is guided by the wireless signal transmitted by the signal transmitters to move to the processing station 700. The sealing mechanism 130 is provided with a protrusion 131 protruding from the surface and is arranged inside or outside the machine body 110, and the protrusion 131 is connected to the sealing mechanism through the bottom of the machine body 110. Alternatively, the sealing mechanism 130 can be a sealing plate. Furthermore, the bottom of the machine body 110 is provided with a retaining hole (not shown) extending along the length direction, so that the protrusion 131 can be movable in the retaining hole. When the sealing mechanism 130 closes the trash discharging port 140, the protrusion 131 is at one end of the retaining hole, and the signal guiding component 80 guides the cleaning robot 100 to travel. As shown in FIG. 5, the sealing mechanism 130 at the bottom of the cleaning robot 100 seals the trash discharging port 140 in the initial state. When the cleaning robot 100 has been introduced within the second signal region 821 by the second signal guiding component 82 and moves forward along the second signal region 821, that is, the cleaning robot 100 continues to move on the ramp 722 of the processing station 700, the protrusion 131 contacts with the auxiliary mechanism 790 on the ramp 722, and when the cleaning robot 100 continues to travel, the auxiliary mechanism 790 abuts the protrusion 131 and pushes the sealing mechanism 130 to open the trash discharging port 140. Specifically, the protrusion 131 moves along the length of the retaining hole. When the protrusion 131 moves to the other end of the retaining hole, the sealing mechanism 130 just fully opens the trash discharging port 140. At this time, as shown in FIG. 6, a dust box 120 is communicated with the trash discharging port 140 through the connecting tube 141, and dust particles are discharged from the trash discharging port 140 along the connecting tube 141, and then the suction device 750 of the processing station 700 provides power, the trash collecting device 760 sucks in the trash, which realizes the intelligent discharge of trash without requiring the user to personally handle the trash on the cleaning robot 100, which improves the user experience.

Figure 9:
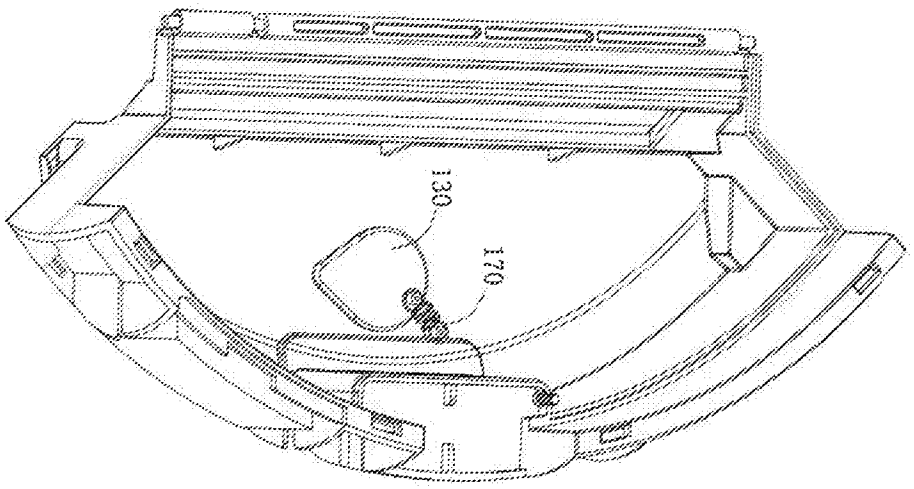
FIG. 9 is an internal schematic diagram of a cleaning robot according to the embodiments of the present disclosure.
Figure 10:
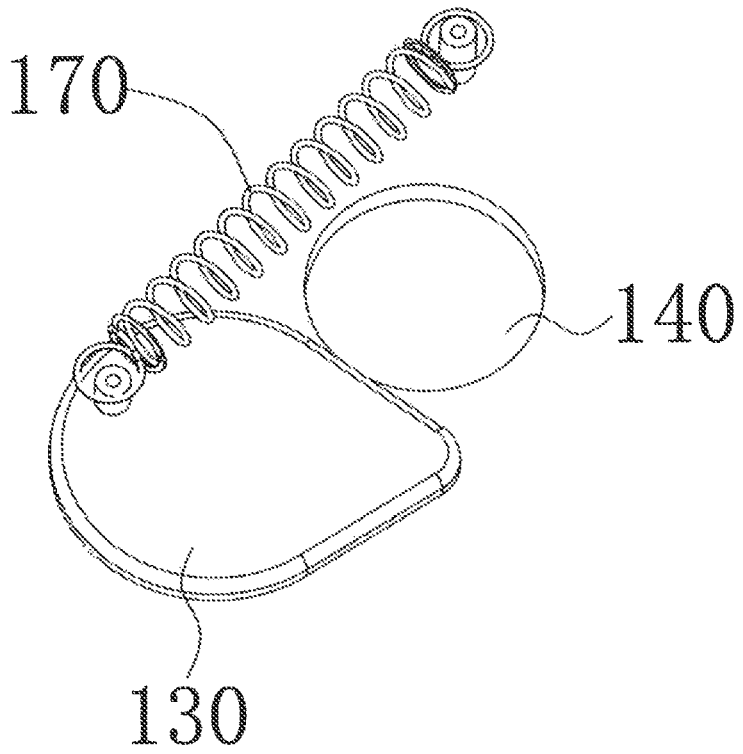
FIG. 10 is a schematic diagram of a resilient return mechanism according to the embodiments of the present disclosure.

The above are the solutions for opening the sealing mechanism 130 of the cleaning robot 100 in the application. After the cleaning robot 100 leaves the processing station 700, the sealing mechanism 130 needs to be closed in time to prevent dust from spilling out when the cleaning robot 100 is used for the second time, which may bring a poor user experience to the user. Based on the above considerations, in the present application, the cleaning robot 100 is provided with the resilient return mechanism 170. The cleaning robot 100 includes the resilient return mechanism 170 in the machine body 110, one end of which is fixed on the machine body 110, and the other end of which is connected to the sealing mechanism 130. FIG. 9 is an internal schematic diagram of the cleaning robot 100 according to the embodiments of the present disclosure; FIG. 10 is a schematic diagram of the resilient return mechanism 170 according to the embodiments of the present disclosure. When the sealing mechanism 130 is pushed away from the trash discharging port 140 by other mechanisms, the resilient return mechanism 170 is in a deformed state. Specifically, the resilient return mechanism 170 can be a spring device, and when the sealing mechanism 130 is pushed away from the trash discharging port 140 by other mechanisms, the spring device is stretched or compressed. After leaving the emptying station, the resilient return mechanism 170 loses external force, and restore under the action of the spring device, so that the sealing mechanism 130 returns to its original position and closes the trash discharging port 140. The sealing mechanism 130 is reset and closes the trash discharging port 140 in time through the resilient return mechanism 170, which realizes the autonomous reset and makes the cleaning robot 100 more intelligent.

Figure 7:
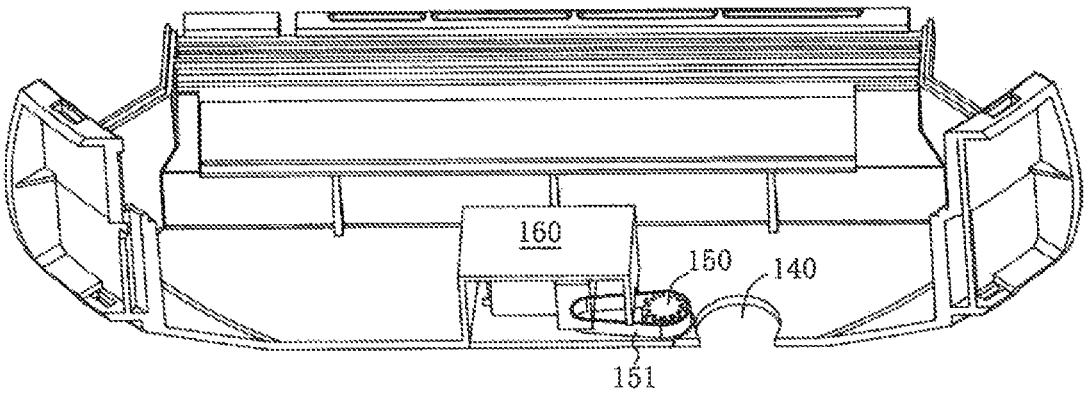
FIG. 7 is a schematic diagram of a first reset mechanism according to the embodiments of the present disclosure.
Figure 8:
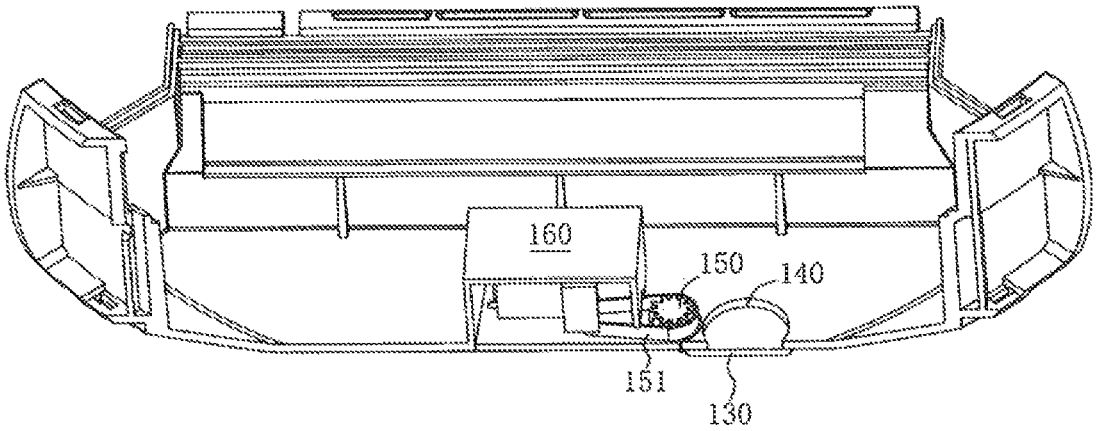
FIG. 8 is another schematic diagram of the first reset mechanism according to the embodiments of the present disclosure.

Alternatively, the cleaning robot 100 further includes a first reset mechanism which is arranged in the machine body 110, and includes a driving mechanism 160, a gear 150 and a conveyor belt 151 for connecting the driving mechanism 160 and the gear 150. The gear 150 and the sealing mechanism 130 are connected. FIG. 7 is a schematic diagram of a first reset mechanism according to the embodiments of the present disclosure, and FIG. 8 is another schematic diagram of the first reset mechanism according to the embodiments of the present disclosure. When the sealing mechanism 130 of the cleaning robot 100 is opened, as shown in FIG. 7, after the cleaning robot 100 leaves the processing station 700, the sealing mechanism 130 needs to be closed in time. After the cleaning robot 100 leaves the processing station 700, the driving mechanism 160 is connected to the gear 150 through the conveyor belt 151. When the driving mechanism 160 rotates, the gear 150 is driven to rotate. The sealing mechanism 130 is reset under the drive of the gear 150. Specifically, as shown in FIG. 8, the sealing mechanism 130 closes the trash discharging port 140 again to prevent dust from spilling out when the cleaning robot 100 is used for the second time, and from bringing a poor user experience to the user. The first reset mechanism drives the sealing mechanism 130 to restore the original state through the gear 150 to realize autonomous reset and make the cleaning robot 100 more intelligent.

In the description of this specification, descriptions with reference to the terms "one embodiment", "some embodiments", "examples", "specific examples", or "some examples" etc. mean that specific features described in conjunction with the embodiment or example, structure, materials or features are included in at least one embodiment or example of the present disclosure. In this specification, the schematic representations of the above terms do not necessarily refer to the same embodiment or example. Moreover, the described specific features, structures, materials, or features can be combined in any one or more embodiments or examples in an appropriate manner. In addition, those skilled in the art can couple and combine the different embodiments or examples and the features of the different embodiments or examples described in this specification without contradicting each other.

The above description is intended to be exemplary embodiments of the present disclosure and not to limit the present disclosure. Any modification, equivalent and alternative falling within the spirit and scope of the present disclosure should be covered in the scope of the present disclosure.

What is claimed is:

1. A cleaning system, comprising:

a cleaning robot comprising a machine body, a trash discharging port and a sealing mechanism provided at the bottom of the machine body for opening or closing the trash discharging port; and a processing station, comprising:

a sealing mechanism actuating device configured to make the movement of the sealing mechanism to open or close the trash discharging port;

a docking sensing assembly configured to sense whether the cleaning robot has docked with the processing station;

a controller configured to obtain sensing information from the docking sensing assembly and control the sealing mechanism actuating device to move the sealing mechanism to open the trash discharging port when the sensing information indicates that the cleaning robot has docked with the processing station; and a first reset mechanism which is arranged in the machine body to reset the sealing mechanism.

2. The cleaning system according to claim 1, wherein the sealing mechanism actuating device is an electromagnet, and the controller controls the sealing mechanism actuating device to generate a magnetic force to attract the sealing mechanism to open the trash discharging port when the sensing information indicates the cleaning robot has docked with the processing station.

3. The cleaning system according to claim 1, wherein the processing station further comprises a ramp, docking sensing assembly comprises a pressure sensor arranged on the ramp and configured to detect the pressure information on the processing station and transmit the pressure information to the controller.

4. The cleaning system according to claim 3, wherein when the pressure is within a preset range, the controller controls an electromagnet to generate a magnetic force to attract the sealing mechanism to open the trash discharging port, and the ramp is provided with a groove where the pressure sensor is mounted;

wherein the preset range is relevant to the weight of the cleaning robot.

5. The cleaning system according to claim 1, wherein the docking sensing assembly is provided with an identification code and the cleaning robot is provided with an alignment recognition device which is configured to recognize the identification code.

6. The cleaning system according to the claim 1, wherein the processing station further comprises:

a base provided with a trash receiving port;

a trash collecting device; and a suction tube communicated with the trash receiving port and the trash collecting device.

7. The cleaning system according to claim 6, wherein the processing station comprises:

a first storage portion, in which the trash collecting device is arranged;

a second storage portion being pneumatic communication with the first storage portion; and a suction device arranged in the second storage portion.

8. The cleaning system according to claim 7, wherein the cleaning robot is provided with a light emitter, the docking sensing assembly is provided with a light receiver which generates a current signal after sensing a light signal, and the controller controls a loop where the sealing mechanism actuating device is to generate a current according to the current signal, so that an electromagnet generates a magnetic force to attract the sealing mechanism away.

9. The cleaning system according to claim 6, wherein the seal mechanism is pushed to move from a position to another position by the sealing mechanism actuating device to open the trash discharging port when the cleaning robot travels to the trash receiving port.

10. The cleaning system according to claim 1, wherein the processing station further comprises a circuit module electrically connected to the sealing mechanism actuating device; when sensing information indicates the cleaning robot has docked with the processing station, the controller controls the circuit module to generate a current to make the sealing mechanism actuating device generate a magnetic force.

11. The cleaning system according to claim 1, wherein the docking sensing assembly is configured as a signal guiding component to guide the cleaning robot to find the processing station and to dock with the processing station.

12. The cleaning system according to claim 11, wherein the signal guiding component comprises a first signal guiding component and a second signal guiding component that emit signals to the surroundings;

wherein the cleaning robot determines the position of the processing station through the first signal guiding component; the second signal guiding component is configured to guide the cleaning robot to travel towards the processing station.

13. The cleaning system according to claim 12, wherein when the cleaning robot has traveled on the processing station, the sealing mechanism actuating device pushes the seal mechanism to open the trash discharging port.

14. The cleaning system according to claim 12, wherein when the cleaning robot has traveled on the processing station, the sealing mechanism actuating device pushes the seal mechanism to slide from a position to another position to open the trash discharging port.

15. The cleaning system according to claim 12, wherein the sealing mechanism is provided with a protrusion protruding from a surface of the sealing mechanism, and when the signal guiding component guides the cleaning robot to travel, the sealing mechanism actuating device abuts against the protrusion and pushes the sealing mechanism to open the trash discharging port.

16. The cleaning system according to claim 12, wherein the cleaning robot comprises a resilient return mechanism; one end of which is fixed on the machine body, and the other end of which is connected to the sealing mechanism.

17. The cleaning system according to claim 1, wherein the first reset mechanism comprises a driving mechanism a gear and a conveyor belt for connecting the driving mechanism and the gear, wherein the gear and the sealing mechanism are connected.

18. A cleaning system, comprising:

a cleaning robot comprising a machine body, a trash discharging port and a sealing mechanism provided at the bottom of the machine body for closing the trash discharging port; and a processing station, comprising:

an auxiliary mechanism;

a signal guiding component comprising a first signal guiding component and a second signal guiding component that emit signals to the surroundings; and a first reset mechanism which is arranged in the machine body to reset the sealing mechanism;

wherein the cleaning robot determines the position of the processing station through the first signal guiding component, the second signal guiding component is configured to guide the cleaning robot to travel, and when the second signal guiding component guides the cleaning robot to travel, the sealing mechanism is pushed away by the auxiliary mechanism.

19. The cleaning system according to claim 18, wherein the sealing mechanism is provided with a protrusion protruding from a surface, and when the signal guiding component guides the cleaning robot to travel, the auxiliary mechanism abuts against the protrusion and pushes the sealing mechanism to open the trash discharging port.

* * * * *